US009761392B2

(12) United States Patent
Zacharias et al.

(10) Patent No.: US 9,761,392 B2
(45) Date of Patent: Sep. 12, 2017

(54) PLATE STACK FOR A COOLING DEVICE IN INSTALLATION DEVICES

(71) Applicant: EATON ELECTRICAL IP GMBH & CO. KG, Schoenefeld (DE)

(72) Inventors: Albert Zacharias, Neuwied (DE); Christian Ruempler, Wexford, PA (US)

(73) Assignee: EATON ELECTRICAL IP GMBH & CO. KG, Schoenefeld (DE)

( * ) Notice: Subject to any disclaimer, the term of this patent is extended or adjusted under 35 U.S.C. 154(b) by 0 days.

(21) Appl. No.: 14/772,412

(22) PCT Filed: Mar. 6, 2014

(86) PCT No.: PCT/EP2014/054360
§ 371 (c)(1),
(2) Date: Sep. 3, 2015

(87) PCT Pub. No.: WO2014/135641
PCT Pub. Date: Sep. 12, 2014

(65) Prior Publication Data

US 2016/0035517 A1 Feb. 4, 2016

Related U.S. Application Data

(60) Provisional application No. 61/773,289, filed on Mar. 6, 2013.

(51) Int. Cl.
*H01H 33/10* (2006.01)
*H01H 9/34* (2006.01)
(Continued)

(52) U.S. Cl.
CPC ..... *H01H 33/10* (2013.01); *H01H 9/342* (2013.01); *H01H 9/36* (2013.01); *H01H 9/52* (2013.01); *H01H 50/12* (2013.01)

(58) Field of Classification Search
CPC H01H 9/342; H01H 9/36; H01H 9/52; H01H 71/02; H01H 33/10; H01H 50/12; F28D 1/0366; F28D 9/0062
(Continued)

(56) References Cited

U.S. PATENT DOCUMENTS 2,244,061 A * 6/1941 Graves, Jr. ..... H01H 9/362 218/149
3,286,065 A * 11/1966 Stringfellow ..... H01H 9/34 218/149
(Continued)

FOREIGN PATENT DOCUMENTS

CN 1282972 A 2/2001
CN 1878933 A 12/2006
(Continued)

*Primary Examiner* — Renee S Luebke
*Assistant Examiner* — William Bolton
(74) *Attorney, Agent, or Firm* — Leydig, Voit & Mayer, Ltd.

(57) ABSTRACT

A plate stack in a cooling device for hot gases generated in electric installation devices, preferably in low-voltage power switches. The plate stack is arranged in the flow path of the hot switching gases into a window, the plate stack having identical plates made of a material with a high heat conductivity. Each of the plates is provided with spacer elements which correspond to the spacing of the plates, and the plates are arranged in the stack such that the orientation of the plates changes one after the other.

16 Claims, 2 Drawing Sheets

(51) Int. Cl.
*H01H 9/36* (2006.01)
*H01H 9/52* (2006.01)
*H01H 50/12* (2006.01)

(58) Field of Classification Search
USPC ..... 218/149, 15, 34, 81, 103, 155, 151
See application file for complete search history.

(56) References Cited

U.S. PATENT DOCUMENTS 3,555,224 A * 1/1971 Frind ..... H01H 9/342 218/149
4,019,005 A * 4/1977 Michetti ..... H01H 9/342 200/306
5,181,562 A * 1/1993 Kuriki ..... B23P 15/26 165/166
5,589,672 A * 12/1996 Uchida ..... H01H 9/342 218/34
5,628,363 A * 5/1997 Dewar ..... F28D 9/0062 165/164
5,655,600 A * 8/1997 Dewar ..... F28D 9/0062 165/166
6,825,431 B2 * 11/2004 Azzola ..... H01H 9/362 218/149
7,034,242 B1 * 4/2006 Shea ..... H01H 9/362 218/157
7,488,915 B2 2/2009 Pollitt et al.
7,705,263 B2 * 4/2010 Rane ..... H01H 9/34 218/149
8,222,555 B2 * 7/2012 Schaltenbrand ..... H01H 9/362 218/34
2006/0086693 A1 * 4/2006 Yeon ..... H01H 9/302 218/149
2011/0108258 A1 5/2011 Magnier-Cathenod et al.
2012/0118542 A1 5/2012 Kanzaka et al.

FOREIGN PATENT DOCUMENTS

CN 201293494 Y 8/2009
CN 102466420 A 5/2012
DE 102010034264 B3 2/2012
EP 0817223 B1 1/1998
WO WO 2009141379 A1 11/2009

* cited by examiner

PLATE STACK FOR A COOLING DEVICE IN INSTALLATION DEVICES

CROSS-REFERENCE TO RELATED APPLICATIONS

This application is a U.S. national stage application under 35 U.S.C. §371 of International Application No. PCT/EP2014/054360, filed on Mar. 6, 2014, and claims benefit to provisional application Ser. No. 61/773,289, filed on Mar. 6, 2013. The International Application was published in German on Sep. 12, 2014, as WO 2014/135641 A2 under PCT Article 21(2).

FIELD

The invention relates to a plate stack for a cooling apparatus in an electrical installation device.

BACKGROUND

In electrical engineering, parallel plate arrangements with defined spacing are known typically as quenching plate stacks. In this case, the plates (quenching plates) are fixed and kept apart inter alia using special lateral walls or trims and are simultaneously also electrically insulated in relation to one another in the process.

A cooling apparatus in low-voltage power switches is known, in which a fine metallic mesh or grating is used (EP 0817223 B1).

Other inventions also relate to cooling the discharged gases; for example U.S. Pat. No. 7,488,915 B2 and DE 102010034264 B3. In the case of these solutions, however, the flow is deflected multiple times. Disadvantages of these arrangements are that a build-up of pressure resulting from the flow deflection occurs along the cooling apparatus, which has an adverse effect on the switching characteristics. If this effect is to be prevented, the cross section must be enlarged. As a result of the complex flow control (inter alia many deflections) and the delicate structure, blockages of the flow passages caused by particles in the discharge and damage to the mesh can occur in the case of fine-cooling meshes (EP 0817223 A1).

SUMMARY

An aspect of the invention provides a plate stack, arranged in a switching gas cooling apparatus of an electrical switching device, the plate stack comprising: identical plates comprising a metallic material having high heat conductivity, the plates being stacked having with a uniform plate spacing, wherein the plates are each provided with spacer elements corresponding to the plate spacing, wherein the plates are arranged in the stack such that their orientation changes successively, and wherein the spacer elements are in the form of deepened stampings in the plates.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1A:
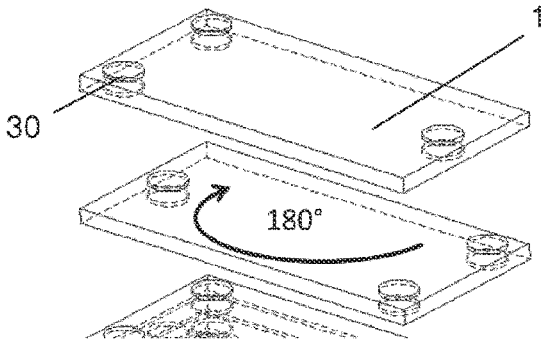
FIG. 1A shows plates having 3 knobs on the edges, rotation in the plane.

An aspect of the invention provides cooling plates in a device on installation devices for cooling discharge gases, which plates are uniformly arranged and can be stacked so as to have a narrow defined spacing.

An aspect of the invention is that the plate stack consists of identical plates made of a material having a high heat conductivity, each of the plates being provided with spacer elements which correspond to the spacing of the plates, and the plates being arranged in the stack such that the orientation of the plates changes successively. The plate stack is arranged in a switching gas cooling apparatus of an installation device.

Spacer elements are provided on the plates for arranging the plates, the plates being formed integrally with the spacer elements.

Metallic plates are to be used, on which spacer elements are produced by means of deep stamping.

During the deep stamping process on thin materials, as a result of plastic deformation a raised spacer element in the form of a bulge emerges on one side and a recess emerges on the opposite side. The invention assumes that the deep stamping process is only performed on one side of the material such that bulges only occur on one side of the material. If the plates were to be stacked at an identical orientation, the raised stampings of one plate would dip into the recesses of the next plate.

As an alternative according to the invention, cooling plates made of ceramic having good heat conductivity can be used, although only spacer elements are formed thereon, with no recesses on the opposite side.

The description of the invention therefore relates especially to metallic cooling plates.

The following advantages can be achieved by the invention

- Plates can be stacked on top of one another at a uniform narrow plate spacing.
- Adherence to a narrowly defined plate spacing.
- Minimal build-up of pressure in the switching chamber, with optimal coordination of plate thickness and plate spacing.
- Solution suitable for volume production.

The parallel cooling plates are arranged having a narrow spacing in the tenth of a millimeter range. Adherence to this narrow spacing is crucial for their function, in particular for cooling and pressure drop. Therefore, a design is selected for the arrangement and fixing of the cooling plates which allows tight tolerances and is suitable for volume production. Furthermore, the parallel cooling plates are to be arranged such that there is adequate sealing against flows such that potentially no exhaust gases leave the switching device past the cooling apparatus uncooled.

The plate stack arrangement according to the invention is designed such that the position and dimensions are insensitive to tolerances. It is advantageous that insulation of the plates relative to each other is not needed.

So that the spacer elements produced by deep stamping can also actually act as spacer elements, the arrangement of the spacer elements of successive plates must be configured differently. This could in principle be achieved by at least two different plate designs having different arrangements of the spacer elements. According to the invention however, only one identical design is used, the plates being arranged in the stack such that their orientation changes successively.

The change in orientation in the plate stack can occur in that successive plates are each rotated by 180° relative to one another in a plane parallel to the surface of the plate or are arranged so as to be tilted by 180° about an edge of the plates. This is facilitated by an asymmetrical arrangement of the spacer elements on the plates (radial asymmetry relative to 180°).

The plates normally have a rectangular format. In the event that the plates are square, a different consideration of radial asymmetry and arrangement of the spacer elements arises accordingly.

The plate stack is part of a cooling apparatus and, in order to function, requires both a retaining device (frame/housing), which holds the plates together, and adequate sealing against lateral flows passing by the plate stack. The plates can preferably be designed such that a window constructed in the cooling apparatus and acting as a frame for the plate stack is smooth on the inside, i.e. has no insertion grooves. A plate stack designed according to the invention holds together well by itself and provides the necessary sealing against a smooth inner wall of the window.

Advantageous embodiments are characterized by the following features, it being possible for the features to be designed on their own or together—where applicable.

The plates can consist of steel, copper or highly heat conductive ceramic.

In plates made from metallic material, the spacer elements (and sealing elements) are formed as deep stampings.

The spacer elements are formed integrally with the plate and have the form of a knob, cone, truncated cone, cylinder or web.

The spacer elements should be formed on only one surface of a plate.

The spacer elements can be formed in the surface of the plate and/or on the edge of the plate.

Asymmetrical arrangement of the spacer elements on the plate surface relative to radial symmetry of 180° about an axis of rotation located on the plate surface.

Asymmetrical arrangement of the spacer elements on the plate surface relative to radial symmetry of 180° about an axis of rotation parallel to an edge of the plate.

Sealing elements can be formed integrally with the plate on the edge of a plate. The height of the sealing elements should be greater than the size of the plate spacing.

The thickness, width and length dimensions (and the quantity) of the plates depend on the desired cooling performance and thus depend on the device class of the installation device.

FIG. 1A to 1E show different variants of the plate design. For one plate stack in a cooling apparatus at least three spacer elements are required (FIG. 1A) in order that the plates come to be located on top of one another in a clearly defined manner having a specified spacing. The spacing of the plates on top of one another (vent width 18 in the window 13 of the cooling apparatus) is determined by the height of the spacer elements, which is achieved by the depth of the punch or stamp. The spacer elements 30, 31 are preferably arranged on the lateral edges or in the vicinity thereof so that the switching gas flow 20 is influenced as little as possible. If it becomes difficult to adhere to the plate spacing as a result of a greater expansion of the plates due to sagging, further spacer elements can also be provided at a greater distance from the lateral edges.

Figure 1B:
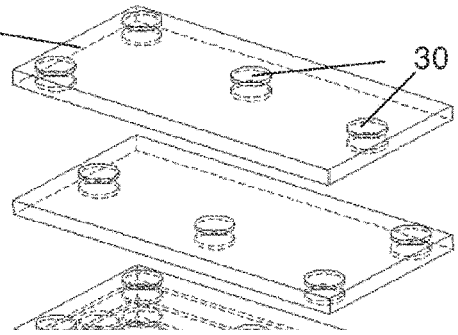
FIG. 1B shows a variant—plate having additional knob in the center.

FIG. 1A shows plates having three knobs 30 on the edges, whereas FIG. 1B shows a second variant which has an additional knob in the centre.

Figure 1C:
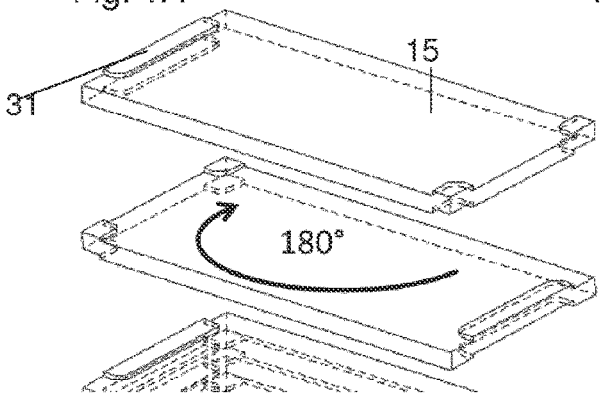
FIG. 1C shows a variant—non-circular knob shape, rotation in the plane.

A third variant is shown in FIG. 1C, in which the spacer elements 32 have a non-circular shape. This means that the shape of the spacer elements is not limited to round elements but can in principle be any shape. Moreover, the elements can also be placed directly on the plate edge, as shown by way of example in FIGS. 1C and 1D. FIGS. 1A and 1C show an asymmetrical arrangement of the spacer elements such that when the plates are rotated by 180° about a vertical axis (perpendicular to the plane of the plate) the spacer elements of two plates lying on top of one another do not come to rest on top of one another.

Figure 1D:
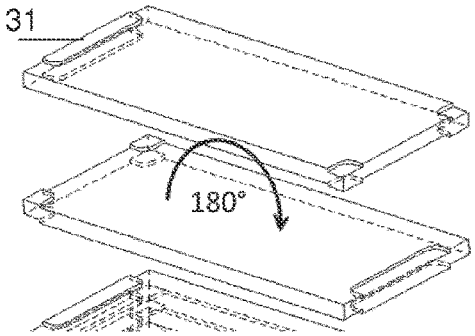
FIG. 1D shows a variant—plates tilted out of the plane.
Figure 1E:
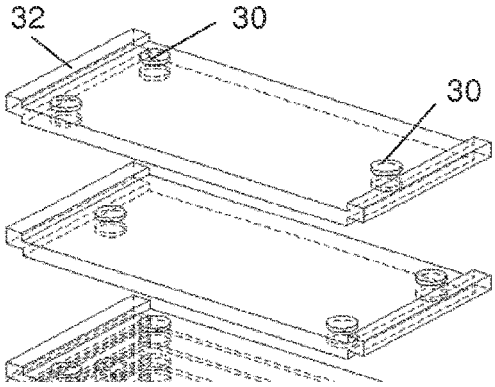
FIG. 1E shows lateral edge webs for sealing.

In FIG. 1D another type of arrangement is shown. Here the desired result is achieved by tilting the plates by 180° about an axis in the plate surface.

The punching or stamping process can also be used to produce lateral seals (sealing elements 32) for the plate stack that the flow passes through. For this purpose, it is proposed that further punchings or stampings are made on the sides of the plates, as shown by way of example in FIG. 1E. In contrast to the spacer elements, the punchings or stampings applied on the edge must engage with one another for sealing and are therefore to be arranged symmetrically. Furthermore, it is helpful to the sealing effect if the lateral stampings are deeper than the height 18 of the spacer elements.

All of the cooling plates 15 have the same thickness 16. Preferably between 500 to 1000 μm or for special applications even in a narrower range of 700 to 900 μm, on average 800 μm.

Figure 2:
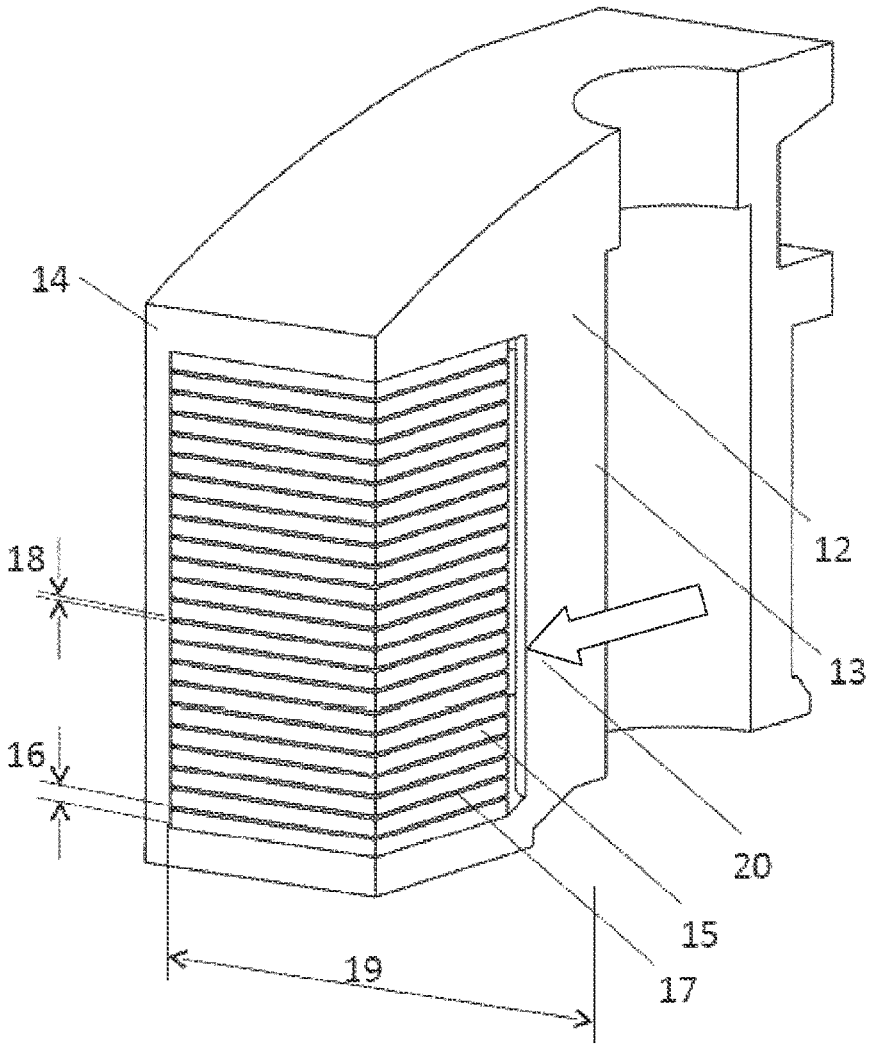
FIG. 2: is a sectional view of a plate stack in a cooling apparatus.

FIG. 2 is a cross-sectional view, the cooling apparatus 10 being cut vertically through the centre (reference numeral 12 being the sectional plane). The exhaust opening for the switching gases is located at the front in the drawing; the rear region of the cooling apparatus points towards the switching chamber of the installation device.

The cooling plates 15 are located transversely to the flow direction 20 and form the cooling plate stack. In the embodiment shown graphically according to FIG. 2, there are twenty-three cooling plates which, together with the frame 14, constitute the thermal capacity of the cooling apparatus by mass, volume and material. Twenty-two vents 17 are formed between the cooling plates.

Vents 17 are the intermediate space between the cooling plates. These have a vent height 18, which is determined by the height of the spacer elements. The vent width 19 is equivalent to the width of the window in the cooling apparatus. Graduated according to the respective anticipated gas mass flow, the height of the spacer elements can be: 100 to 500 μm or 250 to 400 μm, or even narrower 200 to 300 μm. The total cross section of the passage openings is essentially determined by and dependent on the switching performance or nominal current of the installation device. The total cross section of the passage openings in the embodiment shown graphically in FIG. 2 has a size range of 300 $mm^2$ based on a vent height (18) of 0.2 mm, a width (19) of 20 mm and the number of plates as 22.

In principle, the switching gas cooling apparatus comprising the plate stack according to the invention can be used on all electromechanical switching devices which generate a significant amount of discharge gas. This is advantageous in power switches, line circuit breakers and motor circuit breakers in the low-voltage range.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

REFERENCE NUMERALS

12 Sectional plane
13 Window
14 Frame
15 Cooling plate
16 Plate thickness
17 Vent
18 Vent height, height of spacer element
19 Plate width, vent width
20 Switching gas flow
30 Spacer element (cylindrical)
31 Spacer element (web)
32 Sealing element

The invention claimed is:

1. A plate stack, arranged in a switching gas cooling apparatus of an electrical switching device, the plate stack comprising:

identical plates comprising a metallic material having high heat conductivity, the plates being stacked with a uniform plate spacing, wherein the plates have spacer elements formed thereon corresponding to the plate spacing and wherein a height of each individual spacer element defines an entire vent height between the plates, wherein the plates are arranged in the stack such that their orientation changes successively, wherein the spacer elements are in the form of deepened stampings in a planar surface of each plate, and wherein the spacer elements are arranged radially asymmetrically on each plate 180° about one of a) an axis that is perpendicular to the planar surface of the plate and b) an axis that is parallel to the planar surface.

2. The plate stack of claim 1, wherein the plates comprise steel or copper.

3. The plate stack of claim 2, wherein the spacer elements are shaped as knobs, cones, truncated cones, cylinders, or webs.

4. The plate stack of claim 3, wherein the spacer elements are formed only on one surface of the plates.

5. The plate stack of claim 4, wherein the spacer elements are formed in the surface of the plates and/or on an edge of one or more of the plates.

6. The plate stack of claim 4, wherein the spacer elements are formed in the surface of one or more of the plates.

7. The plate stack of claim 6, wherein the spacer elements are formed on the edge of one or more of the plates.

8. The plate stack of claim 4, wherein the spacer elements are formed on the edge of one or more of the plates.

9. The plate stack of claim 2, wherein the plates further comprise a heat conductive ceramic.

10. The plate stack of claim 1, wherein the spacer elements are shaped as knobs, cones, truncated cones, cylinders, or webs.

11. The plate stack of claim 1, further comprising:

a sealing element on an edge of at least one of the plates, and wherein the sealing element is formed integrally with the plate.

12. The plate stack of claim 11, wherein the sealing element is formed as a deepened stamping.

13. The plate stack of claim 11 wherein a height of the sealing element is greater than a size of the plate spacing.

14. The plate stack of claim 1, wherein dimensions and quantity of the plates are adapted to a window in the switching gas cooling apparatus.

15. The plate stack of claim 1, wherein the plates comprise steel.

16. The plate stack of claim 1, wherein the plates comprise copper.

* * * * *